US007746368B2

(12) United States Patent
Park

(10) Patent No.: US 7,746,368 B2
(45) Date of Patent: Jun. 29, 2010

(54) MEDIUM SUPPLYING APPARATUS OF IMAGE FORMING DEVICE

(75) Inventor: Yong-whan Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 699 days.

(21) Appl. No.: 11/733,378

(22) Filed: Apr. 10, 2007

(65) Prior Publication Data

US 2008/0055386 A1 Mar. 6, 2008

(30) Foreign Application Priority Data

Aug. 29, 2006 (KR) ..... 10-2006-0082494

(51) Int. Cl.
*B41J 17/00* (2006.01)
*B65H 1/12* (2006.01)

(52) U.S. Cl. ..... 347/216; 271/160

(58) Field of Classification Search ..... 347/216, 347/215, 218, 222; 271/160, 162, 155, 157, 271/145, 147, 22

See application file for complete search history.

(56) References Cited

U.S. PATENT DOCUMENTS 5,936,653 A * 8/1999 Yamaguchi et al. ..... 347/216
6,149,147 A * 11/2000 Hur et al. ..... 271/160
7,188,835 B2 * 3/2007 Lee et al. ..... 271/147
7,410,162 B2 * 8/2008 Takasaka et al. ..... 271/160

* cited by examiner

*Primary Examiner*—K. Feggins
(74) *Attorney, Agent, or Firm*—Stanzione & Kim, LLP

(57) ABSTRACT

A medium supplying apparatus of an image forming device capable of removing static electricity generating in medium supplying operation by a ground. The medium supplying apparatus includes a medium supplying cassette mounted in a main body of the image forming device, a knock-up plate disposed to be movable up and down in the medium supplying cassette by at least one elastic member and to support printing media, a pickup roller to pick up the printing media loaded on the knock-up plate, a separating unit disposed on medium supplying cassette to separate the printing media one by one when the printing media are picked up, and a ground unit to ground the knock-up plate and the separating unit to the main body.

13 Claims, 6 Drawing Sheets

MEDIUM SUPPLYING APPARATUS OF IMAGE FORMING DEVICE

CROSS-REFERENCE TO RELATED APPLICATIONS

This application claims priority under 35 U.S.C. §119(a) of Korean Patent Application No. 10-2006-0082494 filed Aug. 29, 2006, in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a medium supplying apparatus of an image forming device to pick up and to supply loaded printing media (e.g., paper, transparency or other suitable printing medium) one by one.

2. Description of the Related Art

Generally, an image forming device, such as a copier, a printer, a facsimile, a multifunction machine, or the like, has a function, to form a desired image input from the outside on a printing medium, such as a printing paper. Such an image forming device has a developing unit, a transferring unit, a fixing unit and a medium discharging unit, which are mounted in a main body. In addition, the image forming device has a medium supplying apparatus, which supplies loaded printing media into the main body one by one. An example of such medium supplying apparatus is illustrated in FIG. 1.

Referring to FIG. 1, the medium supplying apparatus includes a medium supplying cassette 10, a knock-up plate 20, a pickup roller 30, and a friction pad 41. The knock-up plate 20 is installed to be movable up and down with respect to the medium supplying cassette 10, and to support printing media. The pickup roller 30 is used to pick up the printing media. The friction pad 41 is used to separate the printing media one by one while facing the pickup roller 30. The friction pad 41 is supported by a supporting holder 42.

To prevent an abrasion (e.g., wear and tear) of the friction pad 41 due to a continuous supply of the printing media, a protecting pad 43 is installed on the supporting holder 42 to come in contact with front ends of the picked-up printing media, as illustrated in FIG. 1.

With the construction as described above, the printing medium supported on the knock-up plate 20 is picked up by the pickup roller 30 to pass over the protecting plate 43 and the friction pad 41, so that the printing medium is separated and conveyed one by one (e.g., one sheet at a time).

However, because of material characteristics of the printing media, the printing media can have a built up electric charge. Thus, static electricity is generated between the printing media and the knock-up plate 20 supporting the printing media. In addition, static electricity is also generated between the pickup roller 30 and the printing media due to friction electrification.

If the printing media loaded on the knock-up plate 20 are relatively small in quantity (e.g., a shorter stack of printing medium sheets), the distance between the knock-up plate 20 and the protecting plate 43 is reduced. Thus, a greater amount of static electricity is generated by electric discharge as the thickness of the stack of printing medium sheets becomes smaller (e.g., as the printing medium sheets get used).

Such generated static electricity during the medium supplying operation can transfer to various parts, such as a controller and the like susceptible to damage by static electricity. As a result, the parts may malfunction, and the image quality may deteriorate.

SUMMARY OF THE INVENTION

The present general inventive concept may be achieved by provides a medium supplying apparatus of an image forming device having an improved structure capable of removing (or reducing) static electricity (e.g., generated static electricity or transferred static electricity) associated with the medium supplying operation by a ground contact.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a medium supplying apparatus of an image forming device including a medium supplying cassette mounted in a main body of the image forming device, a knock-up plate disposed to be movable up and down in the medium supplying cassette by at least one elastic member and to support the printing media, a pickup roller to pick up the printing media loaded on the knock-up plate, a separating unit disposed on medium supplying cassette to separate the printing media one by one when the printing media are picked up, and a ground unit to ground to the main body the knock-up plate and the separating unit.

The ground unit can include a first ground to ground-connect the knock-up plate with the main body, and a second ground to ground-connect the separating unit with the first ground.

The first ground can include a first ground body disposed on the medium supplying cassette and having at least one connecting wing ground-connected with the elastic member, a ground member bent and extended from the first ground body to ground-connect with the main body through a ground hole formed in the medium supplying cassette, and a connecting member extended from the first ground body to connect the first ground body with the second ground.

The first ground body may be fixed to a fixing groove of a seating part disposed in the medium supplying cassette in the form of an interference fit between them, for example.

The second ground can include a second ground body disposed to ground-connect to the separating unit, and a coil spring to elastically connect between the second ground body and the connecting member.

The separating unit can include a friction pad to separate the printing media one by one using friction, a supporting holder to support the friction pad, and a protecting plate disposed on the supporting holder to be in contact with the picked-up printing media ahead of the friction pad to prevent an abrasion of the friction pad, and the ground unit is connected with (or to) the protecting plate.

The second ground body can be disposed on a back surface of the supporting holder to ground-connect with the protecting plate.

The supporting holder can have a plurality of fixing projections formed thereon, and the second ground body can have a plurality of fixing holes formed corresponding to the plurality of fixing projections, so that the second ground body can be fixed to the supporting holder in the form of an interference fit between them.

The second ground body can be integrally formed with and extended from the protecting plate.

The apparatus can further include a cover to protect the first ground.

The foregoing and/or other aspects and utilities of the present general inventive concept are achieved by providing a recording medium tray, including a knock-up plate movably disposed in the tray to elastically support recording media, a separating unit disposed on the tray to separate a single sheet of the recording media being pick-up by a pickup roller, and a ground unit to ground the knock-up plate and the separating unit to the main body

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
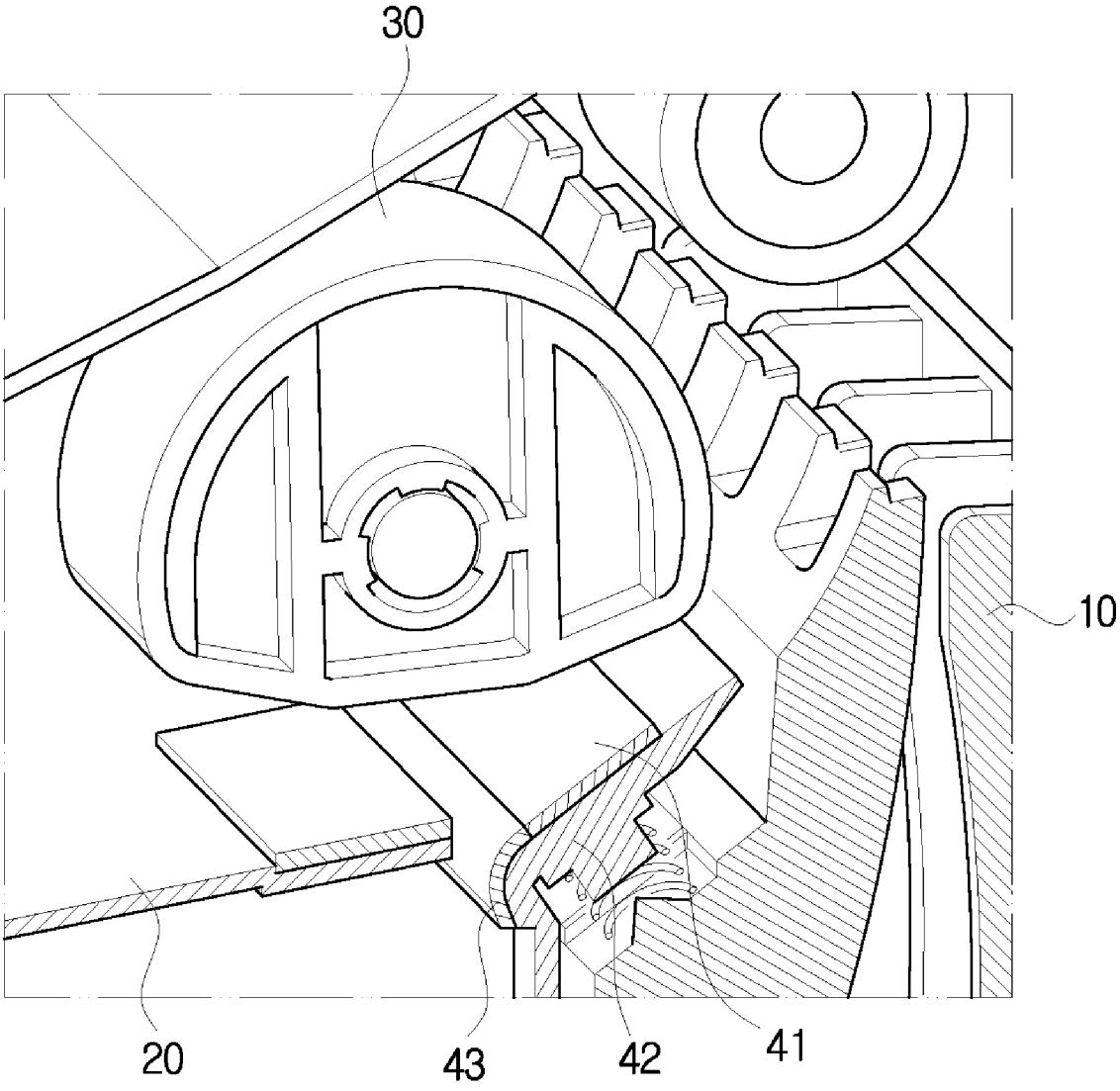
FIG. 1 (PRIOR ART)
FIG. 1 is a perspective view schematically illustrating a conventional medium supplying apparatus of an image forming device.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
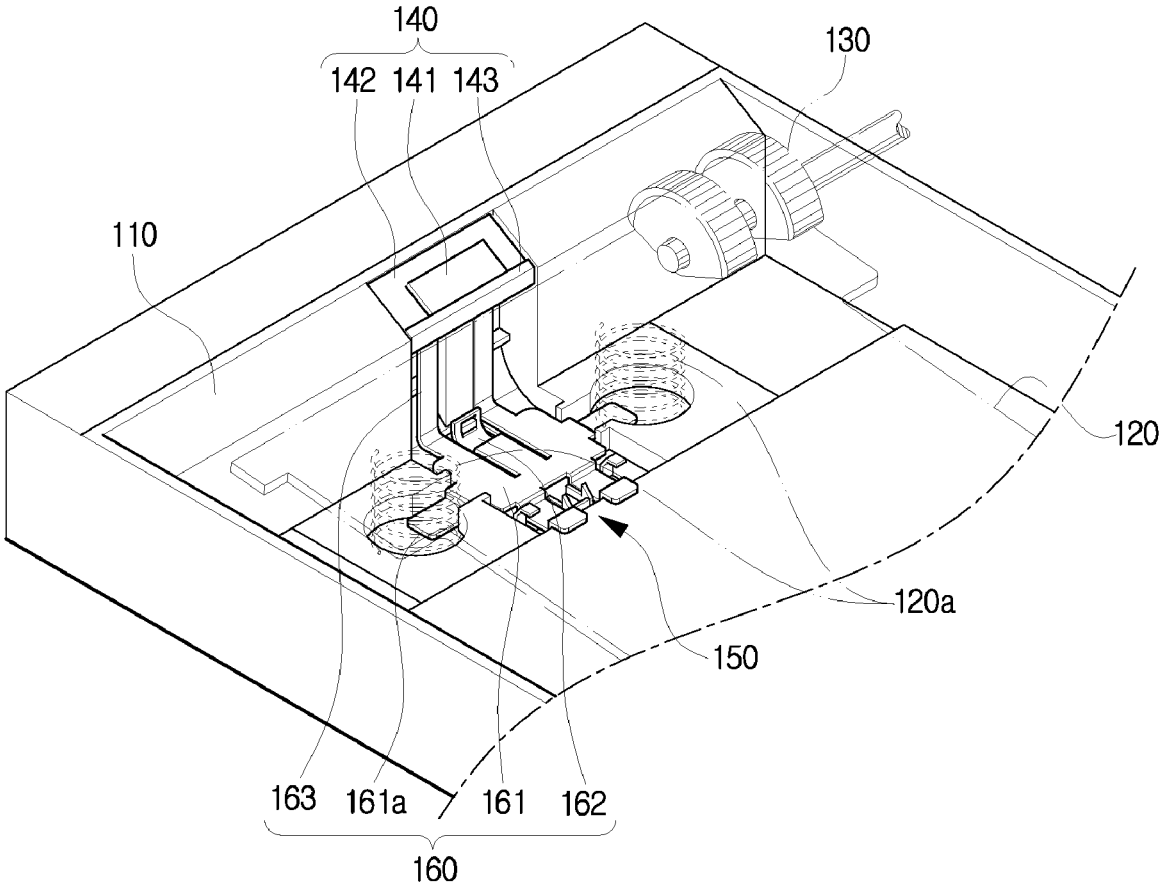
FIG. 2 is a perspective view schematically illustrating a medium supplying apparatus of an image forming device according to an exemplary embodiment of the present general inventive concept.

As illustrated in FIG. 2, the medium supplying apparatus of the image forming device according to an exemplary embodiment of the present general inventive concept includes a medium supplying cassette 110, a knock-up plate 120, a pickup roller 130, a separating unit 140, and a ground unit 150.

Figure 5:
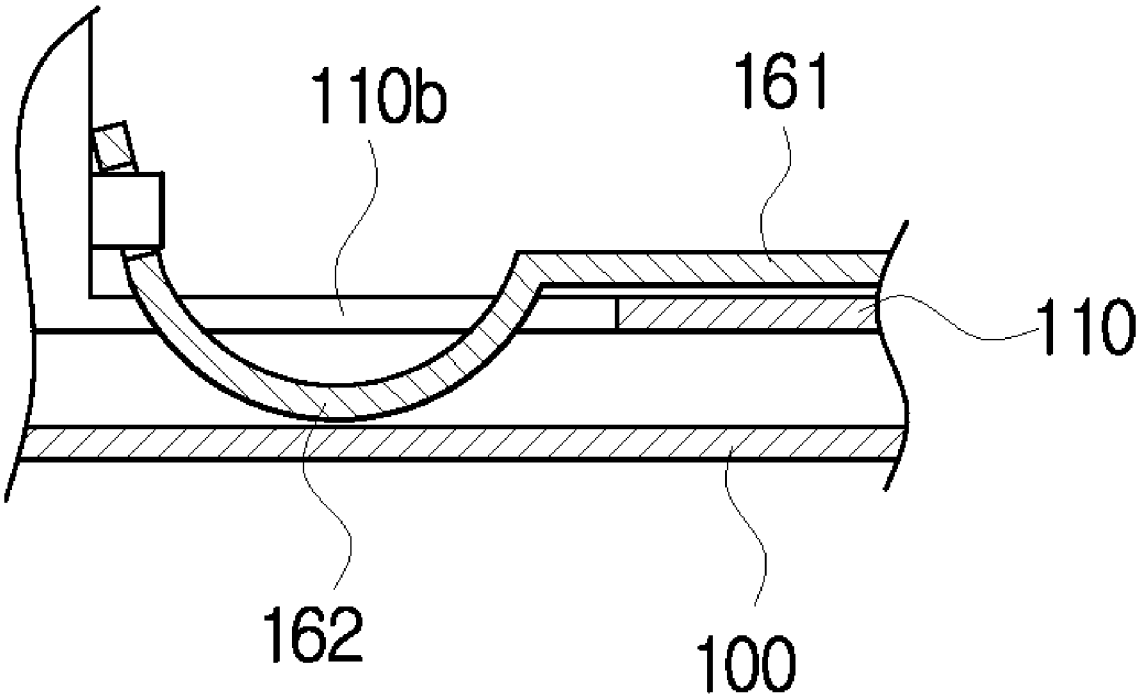
FIG. 5 is a cross-sectional view taken along line V-V in FIG. 3B.

The medium supplying cassette 110 is provided with a space in which printing media, such as printing papers, are stacked, and is mounted in a main body 100 (as illustrated in FIG. 5) of the image forming device. The main body 100 has a series of parts, which are mounted therein to form a desired image on a supplied printing medium. Since constructions of the parts are known in the art when taken in conjunction with this disclosure, a detailed description thereof is omitted for brevity.

The knock-up plate 120 is disposed in the medium supplying cassette 110, and supports the printing media (not illustrated). The knock-up plate 120 is supported by elastic members 120*a* to be movable up and down according to the amount of the printing media loaded thereon. That is, the elastic members 120*a* are disposed between the knock-up plate 120 and the medium supplying cassette 110, for example.

The pickup roller 130 is used to pick up the printing media (not illustrated) loaded on the knock-up plate 120. During pickup, the pickup roller 130 comes in contact with a front portion of the uppermost printing medium sheet in order to pick up the sheet. Since construction of the pickup roller 130 is also known in the art when taken in conjunction with this disclosure, a detailed description thereof is omitted for brevity.

The separating unit 140 can be disposed on the medium supplying cassette 110 to separate (e.g., into separate sheets from a stack of sheets) the printing media picked up by the pickup roller 130 one by one. To be more specific, the separating unit 140 is used to prevent picking up more that one sheet of printing media at one time (e.g., preventing picking up two or more sheets of the printing medium at the same time). Such a separating unit 140 can include a friction pad 141, a supporting holder 142, and a protecting plate 143.

The friction pad 141 can separate the picked-up printing media one sheet at a time using friction. The supporting holder 142 supports the friction pad 141 to be mounted on the medium supplying cassette 110.

The protecting plate 143 can prevent abrasion of the friction pad 141. For this, the protecting plate 143 is installed on the supporting holder 142 to come in contact with front ends (e.g., leading edges) of the picked-up printing media ahead of the friction pad 141, for example.

To be more specific, the friction pad 141 may be worn away potentially leading to deteriorating an efficiency at preventing picking up more than one sheet at a time with repeated contact with the leading edges or leading ends of the picked-up printing media. To prevent the abrasion of the friction pad 141, the protecting plate 143 can be made of a metal material disposed to contact the front ends of the picked-up printing media ahead of the friction pad 141. In this case, medium supplying errors, such as damage, jam, and the like can also be prevented.

Figure 3A:
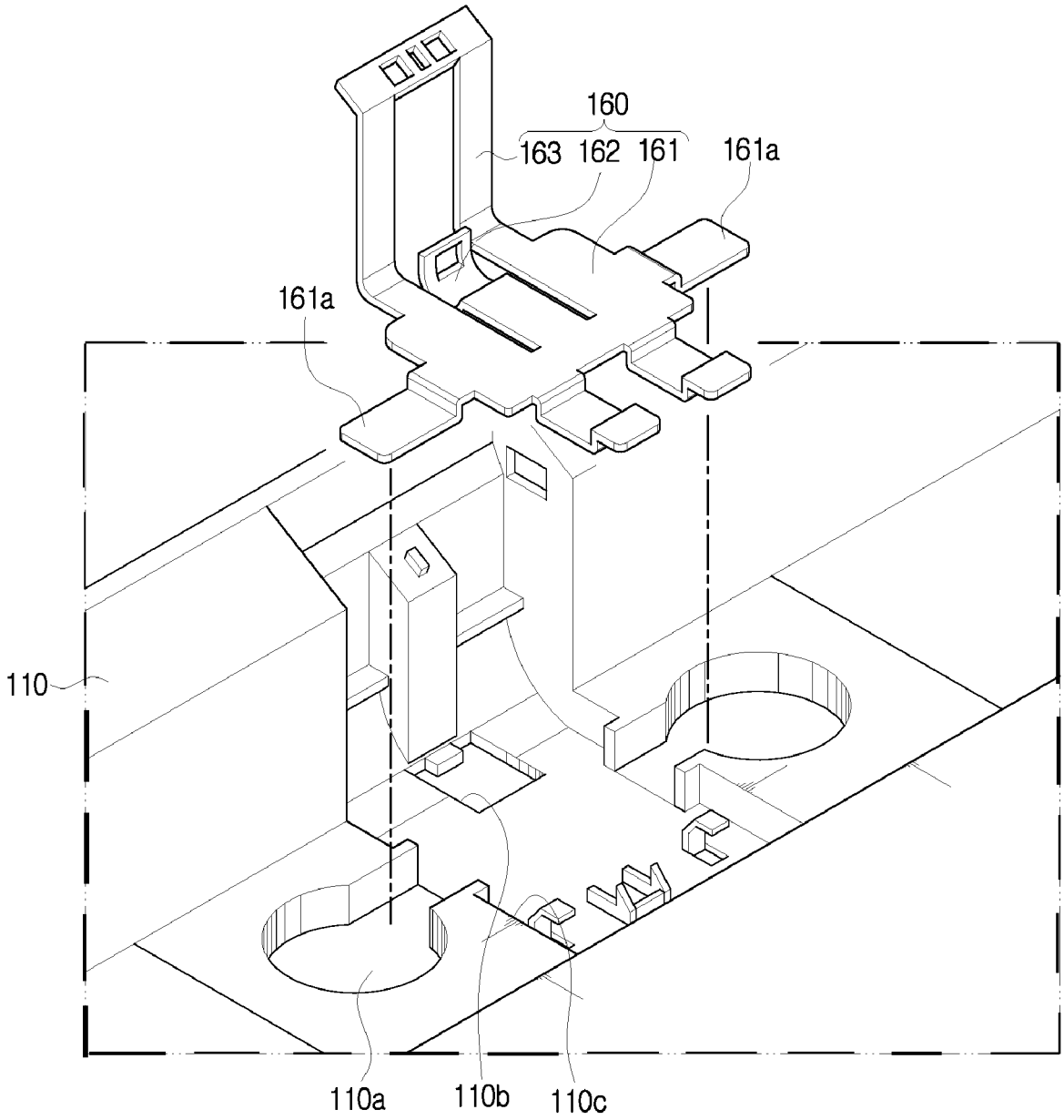
FIG. 3A is an exploded perspective view illustrating mounting of a first ground in a medium supplying cassette of the medium supplying apparatus illustrated in FIG. 2.
Figure 3B:
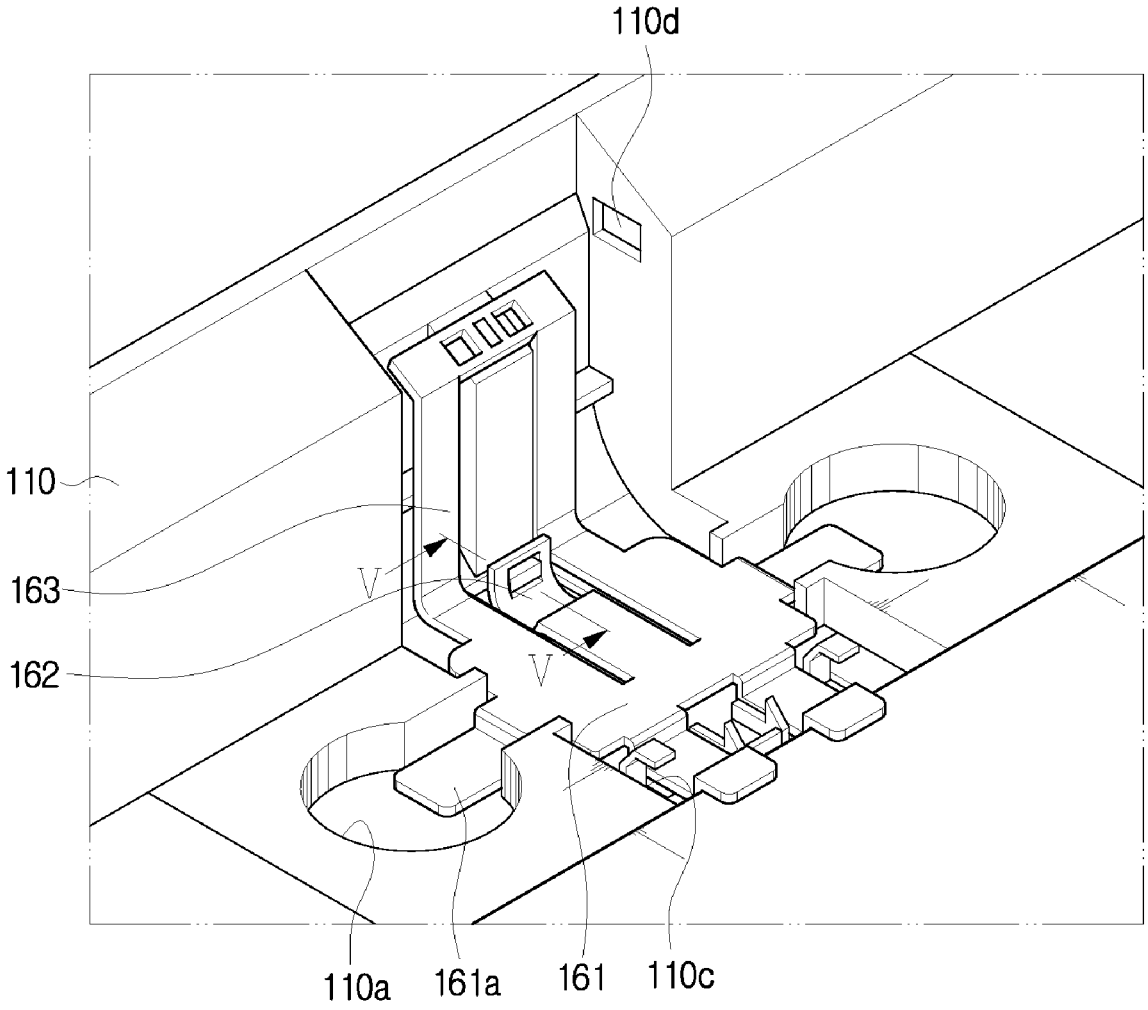
FIG. 3B is a view illustrating the first ground and the medium supplying cassette of FIG. 3A in an assembled state.
Figure 4A:
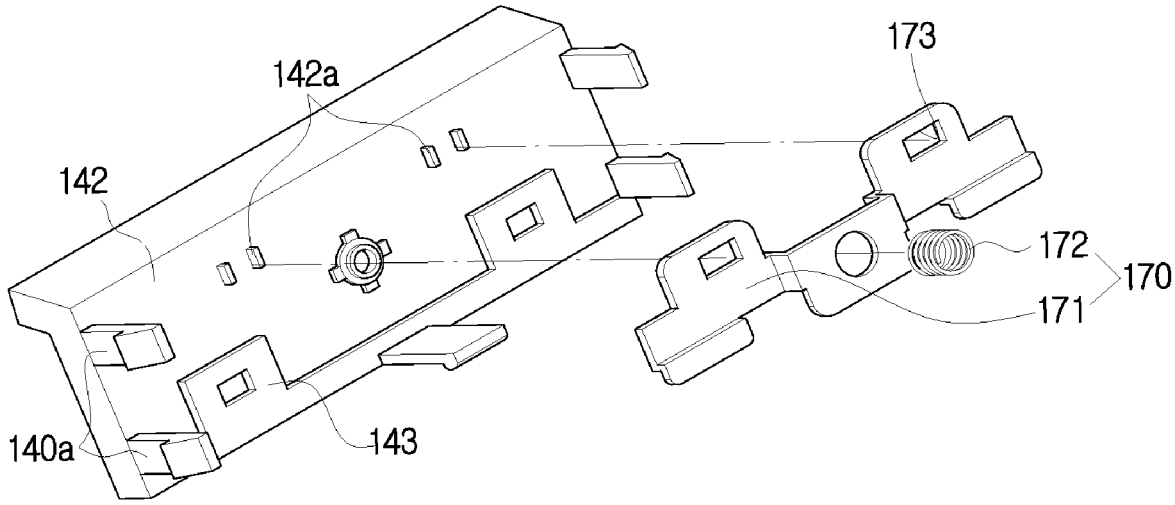
FIG. 4A is an exploded perspective view illustrating mounting of a second ground on a separating unit of the medium supplying apparatus illustrated in FIG. 2.
Figure 4B:
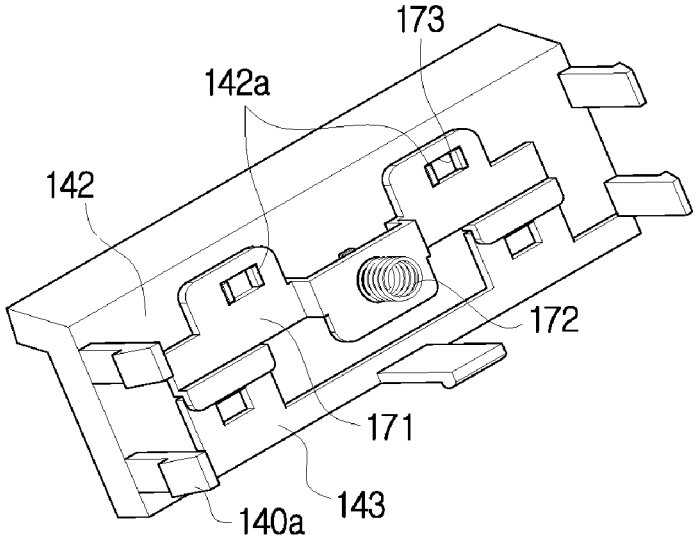
FIG. 4B is a view illustrating the second ground and the separating unit of FIG. 4A in an assembled state.

The separating unit 140 constructed as described above can be provided with a plurality of hooks 140*a*, as illustrated in FIGS. 4A and 4B, to engage with grooves 110*d*, which are formed at positions corresponding to the hooks 140*a* in the medium supplying cassette 110, as illustrated in FIG. 3B.

The ground unit 150 ground-connects the knock-up plate 120 and the separating unit 140 to the main body 100, and includes first and second grounds 160 and 170.

The first ground 160 ground-connects the main body 100 and the knock-up plate 120. For this, as illustrated in FIGS. 3A and 3B, the first ground 160 includes a first ground body 161, a ground member 162 and a connecting member 163.

The first ground body 161 is provided with connecting wings 161*a*, which are ground-connected with the elastic members 120*a* (e.g., springs) supporting the knock-up plate 120, and is disposed in a seating part 110*a* of the medium supplying cassette 110.

Here, the first ground body 161 is fixed to a fixing groove 110*c*, which is formed in the seating part 110*a* of the medium supplying cassette 110, in the form of an interference fit between them. With this construction, ground interference can be prevented, which can occur if metal members, such as screws, are used to fix the first ground body 161 to the medium supplying cassette 110.

The number and positions of the connecting wings 161 a can be formed to correspond to the number and position of elastic members 120*a*. That is, in the exemplary embodiment of the present general inventive concept, since the elastic members 120*a* supporting the knock-up plate 120 are illustrated as a pair of elastic spring members, for example, the connecting wings 161*a* are provided as a pair of corresponding connecting wings.

The ground member 162 can be integrally formed with and bent from the first ground body 161, so that it ground-connects the main body 100 and the first ground body 161. Here, as illustrated in FIGS. 3A and 5, the ground member 162 is connected with the main body 100 through a ground hole 110*b*, which can be penetratively formed in the medium supplying cassette 110.

The connecting member 163 connects the first ground body 161 to the second ground 170. The connecting member 163 cab be bent and extended from the first ground body 161, as illustrated in FIG. 3A, for example.

With the constructions as described above, the first ground body 161, the connecting wings 161*a*, the ground member 162 and the connecting member 163 can be integrally formed, and thus ground-connected with one another.

The second ground 170 ground-connects the separating unit 140 to the first ground 160. Here, as illustrated in FIGS. 4A and 4B, the second ground 170 can include a second ground body 171 and a coil spring 172.

The second ground body 171 can be disposed on a back surface of the supporting holder 142, so that it ground-connects with the protecting plate 143 of the separating unit 140. Here, the second ground body 171 can be provided with a plurality of fixing holes 173, which correspond to a plurality of fixing projections 142*a* formed on the supporting holder 142. According to this, the second ground body 171 can also be fixed to the supporting holder 142 of the separating unit 140 in the form of an interference fit between them, so that ground interference due to fixing with metallic parts is prevented.

In the exemplary embodiment of the present general inventive concept, the second ground body 171 and the protecting plate 143 are illustrated as separately formed from each other. However, they (171 and 143) may be formed as one integral piece That is, the second ground body 171 can be integrally formed with and extended from the protecting plate 143.

The coil spring 172 elastically connects the second ground body 171 to the connecting member 163 of the first ground 160. With this construction, the coil spring 172 ground-connects the first ground 160 to the second ground 170. Thus, the first and the second grounds 160 and 170 together form a single coupled ground, used to discharge static electricity to the main body 100 that may be generated during a printing medium supplying operation.

The first ground 160, which may be exposed to the outside (e.g., unlike the second ground 170 disposed on the back surface of the supporting holder 142) can be protected by a separate cover (not illustrated).

According to the various embodiments described above, and as illustrated in FIG. 2, static electricity that may be generated between the knock-up plate 120 and the printing media can be transferred to the ground-connected first ground 160 through the elastic members 120*a* supporting the knock-up plate 120. In addition, static electricity that may be generated between the pickup roller 130 and the printing media by friction electrification (for example) also can be transferred to the first ground 160 through the knock-up plate 120 supporting the printing media.

Also, static electricity that may be generated between the knock-up plate 120 and the protecting plate 143 in the medium supplying operation may be transferred to the first ground 160 through the second ground 170, which is ground-connected with the protecting plate 143.

The static electricity transferred to the first ground 160 as described above can be finally discharged to the main body 100 through the ground member 162, which is in contact with the main body 100 through the ground hole 110*b* formed in the medium supplying cassette 110, as illustrated in FIG. 5.

As apparent from the foregoing description, according to one or more exemplary embodiments of the present general inventive concept, the medium supplying apparatus of the image forming device can discharge generated static electricity (e.g., generated during the medium supplying operation) to the main body 100 through the ground units 160 and 170. Accordingly, the medium supplying apparatus, according to the exemplary embodiments of the present general inventive concept can prevent the generated static electricity from interfering with operation of the controller or printing of inferior images.

Also, the medium supplying apparatus according to one or more exemplary embodiments of the present general inventive concept can be configured, so that the ground unit connects the knock-up plate and the protecting plate to form a single ground. Accordingly, the medium supplying apparatus according to the exemplary embodiment of the present invention can improve ground efficiency.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A medium supplying apparatus of an image forming device comprising:

a medium supplying cassette mounted in a main body of the image forming device;

a knock-up plate disposed to be movable up and down in the medium supplying cassette by at least one elastic member and to support printing media;

a pickup roller to pick up the printing media loaded on the knock-up plate;

a separating unit disposed on the medium supplying cassette to separate a single sheet of the printing media for pick up by the pickup roller; and a ground unit to ground the knock-up plate and the separating unit to the main body.

2. The apparatus of claim 1, wherein the ground unit comprises:

a first ground to ground-connect the knock-up plate to the main body; and a second ground to ground-connect the separating unit to the first ground.

3. The apparatus of claim 2, wherein the first ground comprises:

a first ground body to be disposed on the medium supplying cassette and having at least one connecting wing ground-connected with the at least one elastic member;

a ground member bent and extended from the first ground body to ground-connect with the main body through a ground hole formed in the medium supplying cassette; and a connecting member extended from the first ground body to connect the first ground body with the second ground.

4. The apparatus of claim 3, wherein the first ground body is fixed to a fixing groove of a seating part disposed in the medium supplying cassette by an interference fit between the first ground body and the seating part.

5. The apparatus of claim 1, wherein the separating unit comprises:

a friction pad to separate the printing media one at a time into single sheets using friction;

a supporting holder to support the friction pad; and a protecting plate disposed on the supporting holder to contact the picked-up printing media in front of the friction pad to prevent abrasion of the friction pad, and wherein the ground unit is connected with the protecting plate.

6. The apparatus of claim 2, further comprising a cover to protect the first ground.

7. The apparatus of claim 3, wherein the second ground comprises:

a second ground body disposed to ground-connect to the separating unit; and a coil spring to elastically connect the second ground body with the connecting member, wherein the coil spring is disposed between the second ground body and the connecting member.

8. The apparatus of claim 7, wherein the separating unit comprises:

a friction pad to separate the printing media one at a time into single sheets using friction;

a supporting holder to support the friction pad; and a protecting plate disposed on the supporting holder to contact the picked-up printing media in front of the friction pad to prevent abrasion of the friction pad, and wherein the ground unit is connected with the protecting plate.

9. The apparatus of claim 8, wherein the second ground body is disposed on a back surface of the supporting holder to ground-connect with the protecting plate.

10. The apparatus of claim 8, wherein the supporting holder has a plurality of fixing projections formed thereon, and the second ground body has a plurality of corresponding fixing holes to accept the plurality of fixing projections so that the second ground body is fixed to the supporting holder by an interference fit between the second ground body and the supporting holder.

11. The apparatus of claim 8, wherein the second ground body is integrally formed with and extended from the protecting plate.

12. A recording medium tray, comprising:

a knock-up plate movably disposed in the tray to elastically support recording media;

a separating unit disposed on the tray to separate a single sheet of the recording media being pick-up by a pickup roller; and a ground unit to ground the knock-up plate and the separating unit to the main body.

13. The apparatus of claim 12, wherein the ground unit comprises:

a first ground to ground-connect the knock-up plate to the tray; and a second ground to ground-connect the separating unit to the first ground.

* * * * *